US005648009A

United States Patent [19]

Johnston

[11] Patent Number: 5,648,009

[45] Date of Patent: Jul. 15, 1997

[54] APPARATUS FOR ADJUSTABLY MOUNTING A MOLD BOX

[75] Inventor: Llewellyn L. Johnston, Vancouver, Wash.

[73] Assignee: Columbia Machine, Inc., Vancouver, Wash.

[21] Appl. No.: 458,103

[22] Filed: Jun. 1, 1995

[51] Int. Cl.[6] ..... B28B 7/24

[52] U.S. Cl. ..... 249/129; 249/155; 249/165; 249/166; 425/183; 425/186; 425/195

[58] Field of Search ..... 249/129, 130, 249/131, 155, 160, 163, 165, 213, 216, 219.1, 166, 169; 425/195, 183, 186

[56] References Cited

U.S. PATENT DOCUMENTS

| | | | |
|---|---|---|---|
| 1,642,247 | 9/1927 | Krause | 249/169 |
| 1,688,627 | 10/1928 | Long | 425/123 |
| 1,887,403 | 11/1932 | Evans | 249/103 |
| 3,360,231 | 12/1967 | Hezik | 249/169 |
| 4,442,995 | 4/1984 | Grady, II | 249/163 |
| 4,451,022 | 5/1984 | Sauger | 249/165 |
| 5,297,772 | 3/1994 | Stefanick | 249/129 |

OTHER PUBLICATIONS

Brochure entitled "Mold Box Assembly" by Columbia Machine, Inc., pp. 2.1–2.106, 1993.

Schematic drawing by L. Johnston, #C–200–2269, Feb. 21, 1980.

Schematic drawing by Christopherson, #B699582.25.1, Dec. 7, 1990.

Schematic drawing by R. Dunn, #D–200–3124, Nov. 21, 1986.

*Primary Examiner*—Jay H. Woo

*Assistant Examiner*—Minh-Chau T. Pham

*Attorney, Agent, or Firm*—Marger, Johnson, McCollom & Stolowitz, P.C.

[57] ABSTRACT

An apparatus for mounting a mold box on a machine for forming molded concrete products includes a mold defining a cavity for receiving cement having a pair of opposed side plates and a pair of opposed mounting brackets. A mold support frame is further included having a pair of opposed side beams and a pair of opposed end brackets, with a connecting device for mounting the support frame on the machine. A pair of opposed substantially parallel slots is formed on the support frame side beams and a sliding plate is receivable in the slots and slidable therealong. A slot is also formed on one of the mold mounting brackets, such that the sliding plate is receivable in the slot formed on the mold mounting bracket.

17 Claims, 2 Drawing Sheets

APPARATUS FOR ADJUSTABLY MOUNTING A MOLD BOX

BACKGROUND OF THE INVENTION

The present invention relates to mold box assemblies and, more particularly, to an apparatus and method for adjustably mounting a mold box in a machine for forming molded concrete products.

There are several problems that occur with prior art machines for forming concrete products. One of the primary problems is with the vibrator system. As the vibrator system shakes the mold assembly, such vibration causes the entire machine to shake, thereby dampening vibration in the mold assembly and causing uneven spread of cement material. In addition, the vibration fatigues machine parts and alters clearances between primary parts in the machine. Thus, machine and mold box operating life is reduced; product quality is adversely affected, deteriorating even further as the machine ages.

Another problem associated with prior art machines for forming concrete products relates to the fact that various-sized mold boxes are constantly exchanged in the machine to produce different product shapes. When a new mold box is mounted in the machine, major adjustments or realignments are necessary so that the machine can properly engage mold boxes of different heights. The head assembly and mold assembly must also be jimmied until properly aligned together. Thus, with prior art machines, when mold boxes are exchanged, a significant amount of time is required to properly mount and align a new mold box in the machine. This results in machine downtime and reduces overall product output.

In order to overcome the above-described problems with the prior art machines, a novel method and apparatus for forming concrete products was designed for the high speed manufacturing of a wide variety of high quality products. This new method and apparatus was disclosed in U.S. Pat. No. 5,395,228 to Aeseth et al., for Apparatus for Forming Concrete Products and is incorporated herein by reference. That invention increased vibration control in a concrete product forming machine, reduced the amount of time required to mold concrete products, increased the homogeneous consistency of concrete products, and reduced the amount of time required to exchange and align molds in a concrete product forming machine.

A novel self-aligning mold box assembly for use in a machine for forming concrete products, such as the machine disclosed in U.S. Pat. No. 5,395,228 to Aeseth et al., is disclosed in my U.S. patent application Ser. No. 08/361,790, filed in the U.S. Patent and Trademark Office on Dec. 21, 1994, and incorporated herein by reference.

Another novel mold box assembly for use in a machine for forming concrete products, such as the machine disclosed in U.S. Pat. No. 5,395,228 to Aeseth et al., is disclosed in my U.S. patent application Ser. No. 08/373,936 for Method and Apparatus for Securing Partition Plates in a Mold, filed in the U.S. Patent and Trademark Office on Jan. 13, 1995, and incorporated herein by reference.

While both the machine for forming concrete products disclosed in U.S. Pat. No. 5,395,228 to Aeseth et al. and the two new mold box assemblies disclosed in my U.S. patent application Ser. No. 08/361,790 and my U.S. patent application Ser. No. 08/373,936 have substantial advantages over the prior art, a practical problem with converting to the new machine and mold box assemblies has been encountered. A customer who purchases the new concrete product forming machine also has to purchase new molds designed for use in the new machine. While some manufacturing operations produce only a limited number of products and, hence, need only a few types of molds, other manufacturing operations make a broad spectrum of concrete products and, consequently, may use up to 50 different types of molds for a single machine for making the different products. Obviously, buying a new machine and purchasing upwards of 50 new molds create a substantial expense for a business.

SUMMARY OF THE INVENTION

Accordingly, it is a general object of the present invention to provide an apparatus and method which adapts a smaller mold box for use in a machine for forming concrete products which is designed for use with a larger mold box.

It is a further object of the present invention to provide an apparatus and method for facilitating the use of the old-style molds with the new machines for forming concrete products, such as the type disclosed in U.S. Pat. No. 5,395,228 to Aeseth et al.

It is yet a further object of the invention is to provide an apparatus and method which adapt the old-style molds for use with the new machines for forming concrete products, but yet retains the advantages associated with using the new machines.

It is an additional object of this invention to provide an apparatus and method for adapting such old-style molds for use with the new machines, which are easy and economical to use.

These and other objects and advantages are accomplished by providing an apparatus for mounting a mold box on a machine for forming molded concrete products which comprises a mold defining a cavity for receiving cement, having a pair of opposed side plates and a pair of opposed mounting brackets. The apparatus further includes a mold support frame having a pair of opposed side beams and a pair of opposed end brackets, with a connecting device for mounting the support frame on the machine. A pair of opposed substantially parallel slots is formed on the support frame side plates and a sliding plate is receivable in the slots and slidable therealong. A slot is also formed on one of the mold mounting brackets, such that the sliding plate is receivable in the slot formed in the mold mounting bracket.

The present invention also provides a method for assembling a mold box for use in a machine for forming molded concrete products having a substantially rectangular mold box with a pair of opposed side plates and a pair of opposed mounting brackets having a slot formed on the brackets and further having a substantially rectangular support frame for receiving the mold box with a pair of opposed side beams, a slot formed on a side of one of the side beams, and a pair of opposed end brackets positioned at opposite ends of the side beams, with the method designed to adapt a support frame having substantially longer side beams than the side plates of the mold box. The method includes the steps of removing one of the frame end brackets, installing in the frame a pair of sliding substantially rectangular spacers, with each spacer having an expanse disposed adjacent one of its ends receivable in the slot on the one side beam and slidable therealong. The next step is fixedly mounting the one end bracket to the ends of the side beams and placing the mold box in the frame. Then, the last step is to slide the spacers into the slots on the mounting bracket.

Thus, it can be appreciated that my novel apparatus and method disclosed above can be used to adapt smaller-sized mold boxes for use in any concrete product forming machine having a larger mold box support frame.

The foregoing and other objects, features and advantages of the invention will become more readily apparent from the following detailed description of a preferred embodiment which proceeds with reference to the drawings. BRIEF DESCRIPTION OF THE DRAWINGS FIG. 1 is a perspective view of a mold box assembly, shown in an assembled condition, constructed in accordance with the present invention, with portions of the mold box shown in dashed lines.

DETAILED DESCRIPTION OF THE PREFERRED EMBODIMENT

Figures 1, 2:
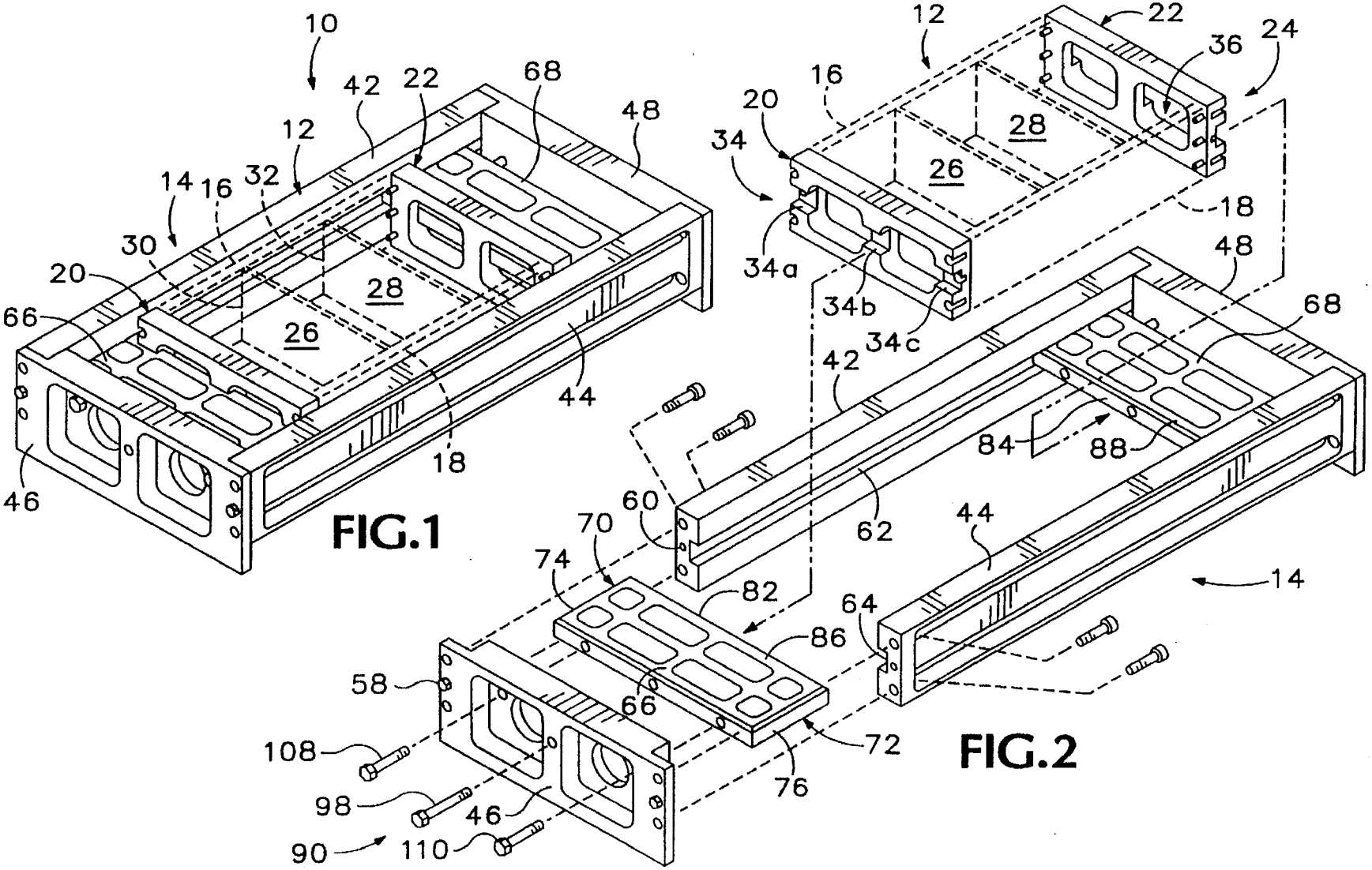
FIG. 2 is a partially exploded view of the mold box assembly of FIG. 1, with the mold box shown removed from the mold box assembly and portions thereof shown in dashed lines.

Turning now to FIGS. 1 and 2, indicated generally at 10 in FIG. 1, is a mold box assembly incorporating the present invention, with a mold box, shown generally at 12, received in a mold box support frame, shown generally at 14.

As best seen in FIG. 2, mold box 12 includes a pair of opposed, substantially parallel side plates 16, 18 shown in dashed lines, and a pair of opposed, substantially parallel mounting brackets 20, 22 which are positioned at opposite ends of side plates 16, 18. Mounting brackets 20, 22 are secured to side plates 16, 18 by bolts indicated generally at 24. Partition plates 26, 28, shown in dashed lines, extend between side plates 16, 18 and include end surfaces, such as surfaces 30, 32 shown in FIG. 1, which flushly abut an interior side of each side plate. The spaces between partition plates, such as plates 26, 28, provide cavities into which wet cement is compressed and thereafter stripped therefrom to form a molded concrete product.

A pair of elongate slots or couplers 34, 36 are formed centrally on the outer planar surfaces or sides of mounting brackets 20, 22. Coupler 34 includes slots 34*a*, 34*b*, 34*c*. Coupler 36 is substantially identical to coupler 34. Mounting bracket 22 is substantially identical to mounting bracket 20. Coupler 36 is also substantially identical to coupler 34.

As illustrated in FIGS. 1 and 2, support frame 14 includes a pair of opposed, substantially parallel side beams 42, 44 and a pair of opposed, substantially parallel end brackets 46, 48 positioned at opposite ends of side beams 42, 44, which together define a substantially rectangular frame having four corner portions as shown. An alignment pin, such as pin 58 shown in FIG. 2, is mounted on the end bracket at each corner portion and an alignment bore, such as bore 60, coaxial with the pin, is formed on the side beam. The bores are sized and positioned so that, when each bore has its associated alignment pin therein, the mold box support frame is sufficiently aligned to form molded products, all as more fully described in my U.S. patent application Ser. No. 08/361,790 for Self-Aligning Mold Box Assembly.

As seen in FIG. 2, a pair of elongate slots 62, 64 is formed on the inner sides of side beams 42, 44.

A pair of substantially rectangular spacers or plates 66, 68, shown in FIGS. 1 and 2, are provided for assembly 10. Spacer 66 has an expanse, shown generally in FIG. 2 at 70, 72, disposed adjacent each of its ends 74, 76. Spacer 68 also has an expanse 78, 80 (not shown) disposed adjacent each of its ends. Expanses 70, 72 and 78, 80 of spacers 66, 68 are received in slots 62, 64 respectively, of side beams 42, 44 and slidably travel therealong.

The sides 82, 84 of spacers 66, 68 respectively, are provided with elongate lip portions 86, 88 which couple with elongate slots or couplers 34, 36 on mounting brackets 20, 22.

Figure 4:
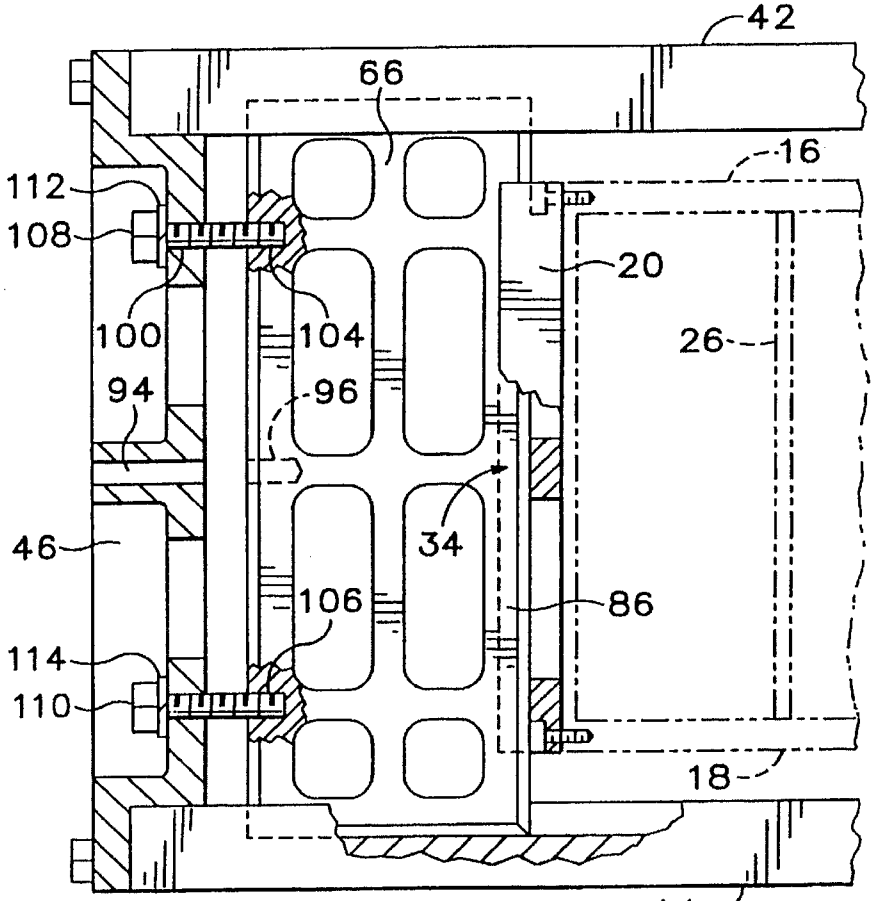
FIG. 4 is a top plan view, similar to FIG. 3, of the mold box assembly shown in partial cross section showing the sliding plate in a fully extended position fully received in a slot formed in the mounting bracket of the mold box, in a condition when the mold box is mounted ready for receiving cement product.
Figure 3:
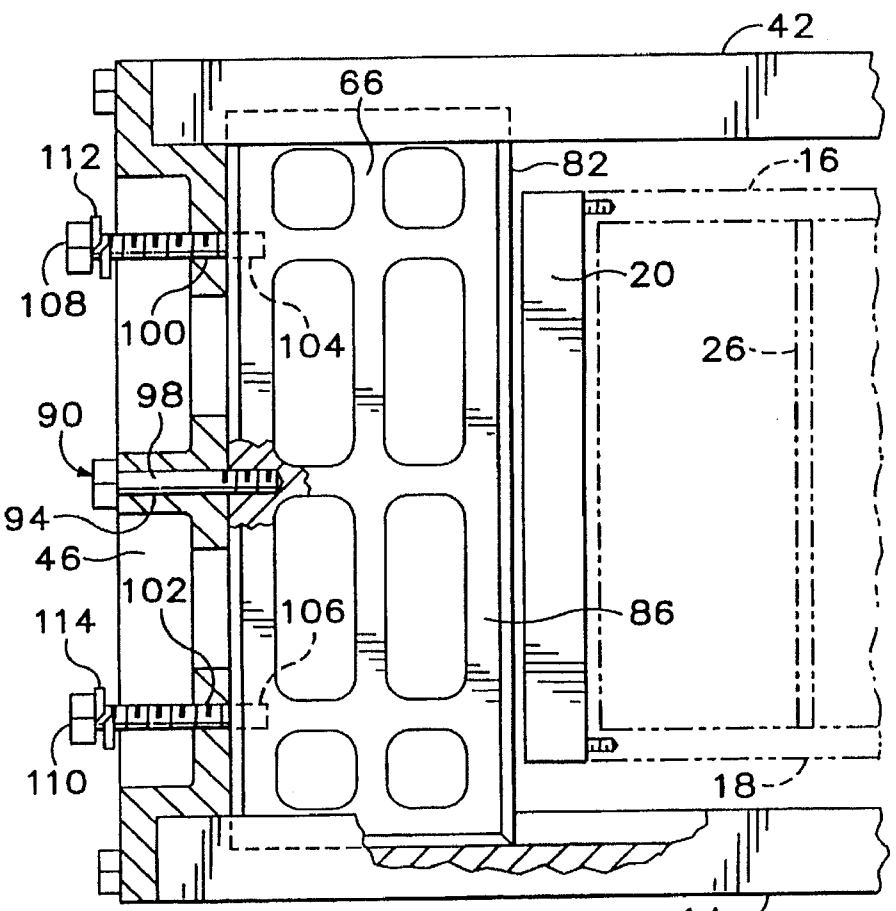
FIG. 3 is a top plan view of the mold box assembly shown in FIG. 1, shown in partial cross section, illustrating a condition where a sliding plate is in a fully retracted position in order to accommodate exchange of mold box assemblies.

As best seen in FIGS. 3 and 4, a pair of retractors, one of which is retractor 90, are included in assembly 10 for moving spacers 66, 68 in order to adjustably accommodate exchange of smaller mold boxes, such as box 12, in assembly 10. The other retractor, not visible in the drawings, is located at the opposite end of mold box assembly 10 and is substantially identical to retractor 90. Retractor 90 includes a bore 94 disposed centrally in frame end bracket 46, and a threaded bore 96, disposed centrally in a side of spacer 66, with the bore and the threaded bore being coaxial with respect to each other. Retractor 90 further includes an associated bolt 98, which is threaded adjacent its end so as to engage spacer 66 when the bolt is fully extended through the bores.

Each frame end bracket, such as end bracket 46, further includes a pair of threaded bores, such as bores 100, 102 (FIGS. 3 and 4), spaced apart from each other, and each spacer, such as spacer 66, has a pair of corresponding bores having ends, such as bores 104, 106, disposed in the spacer, with the threaded bores in the end brackets and the bores in the spacers being coaxial with respect to each other. A pair of associated bolts threaded adjacent their heads, such as bolts 108, 110, are provided to engage the threaded bores, such as bores 100, 102, in the end brackets, such as end bracket 46, when the bolts are fully extended through the end brackets with the ends of the bolts abutting the ends of the spacer bores, such as spacer bores 104, 106. Lock washers, such as washers 112, 114, are provided for each bolt, such as bolts 108, 110, to lock the bolts in place, as shown in FIG. 4.

A mold box having substantially shorter side plates than the side beams of the mold box support frame may be adapted by the method of the invention by removing one of the frame end brackets, such as end bracket 46, and installing in the frame a pair of spacers, such as spacers 66, 68, with the expanses of each spacer received in the slots, such as slots 62, 64, of side beams 42, 44 to slidably travel therealong. The end bracket is then fixedly mounted on the ends of the frame side beams. The retractor 90 retractably moves spacer 66 to accommodate placement or exchange of mold boxes, such as box 12, in assembly 10. Bolt 98 is threaded through central bore 94 on the frame end bracket and into threaded bore 96 to engage spacer 66, and move the spacer outwardly toward the frame end brackets, as best seen in FIG. 3. The mold box is placed in the frame, and the spacers are slid into the slots on the mounting brackets of the mold box by movement of bolts, such as bolts 108, 110 through threaded bores 100, 102 in the end brackets, such as end bracket 46, with the ends of the bolts abutting the end of the spacers bores, such as spacer bores 104, 106. The lock washers, such as washers 112, 114 then are engaged to lock the bolts in place, as shown in FIG. 4. So positioned, the spacers are flushly received in the slots in the box mounting brackets and the mold is ready to be filled with wet cement material.

It can thus be seen that the structure and method provided by the present invention produces important advantages. First, the vertical vibration forces imparted to mold box assembly 10 during operation are distributed over a relatively larger area. Specifically, the top and bottom surfaces of spacer 66 are substantially flushly abutted against the top and bottom surfaces of slots 34*a*, 34*b*, 34*c*. Similarly, top and bottom surfaces of spacer 66 are substantially flushly abutted against the top and bottom edges of slots 62, 64. Vertical vibration forces set up in mold box 12 are thus spread over a larger area than if mold box 12 were, e.g., simply bolted to mold box support frame 14 at several locations. When bolts are used, as in prior art adapters, only the heads of the bolt resist upward forces imparted to the mold box.

Another advantage of the present invention relates to the ease of changing a mold box, like mold box 12, out of the mold box support frame and mounting a different mold box thereon. To achieve the same, bolts 108, 110 are unscrewed from the position of FIG. 4 to that of FIG. 3 and bolt 98 is inserted through bore 94 and into threaded bore 96. Threaded bolt 98 moves spacer 66 into configuration of FIG. 4 to that of FIG. 3. When the same procedure preformed on the structure associated with spacer 68 at the opposite end of the assembly, both spacers are withdrawn to the position of FIG. 3, thereby allowing mold box 12 to be removed by withdrawing the same through the top or bottom of mold box support frame 14. The mold box to be installed, which includes mounting brackets substantially identical to mounting brackets 20, 22, is inserted into frame 14 in the same position as mold box 12 is depicted in FIG. 1. Thereafter, bolt 98 (in FIG. 3) is removed, bolts 108, 110 are screwed in to slide spacer 66 into bores 100, 102 the configuration shown in FIG. 4. Substantially the same procedure is performed on structure at the opposite end of assembly 14 to urge spacer 68 into the slots making up coupler 36 in the same fashion that spacer 66 is urged into slots 34*a*, 34*b*, 34*c*.

While a preferred construction for, and methods of practicing the invention have been disclosed herein, it is appreciated that variations and modifications may take place without departing from the spirit of the invention.

I claim:

1. In a machine for forming molded concrete products, a mold box assembly for adjustably mounting a mold box for receiving concrete, the assembly comprising:

a substantially rectangular mold box having a pair of opposed, substantially parallel side plates and a pair of opposed substantially parallel mounting brackets positioned at opposite ends of said side plates;

a support frame, for receiving said mold box, having a pair of opposed, substantially parallel side beams and a pair of opposed, substantially parallel end brackets positioned at opposite ends of the side beams, which together with the side beams form a substantially rectangular frame;

a spacer for adjustably accommodating different-sized mold boxes, disposed intermediate one of the frame end brackets and one of the mold box mounting brackets and moveable therebetween the two; and a retractor coupled to the spacer to move said spacer to accommodate placement of said mold box in said frame.

2. An assembly according to claim 1 wherein said pair of frame side beams are longer than said pair of mold box side plates.

3. An assembly according to claim 1 which further comprises a coupler for engaging said spacer with said one of the box mounting brackets.

4. The mold box assembly of claim 1, wherein at least one of said pairs of mold box mounting brackets includes an outer planar surface and said spacer includes an elongate lip disposed adjacent one of the spacer sides, and wherein said coupler comprises an elongate slot on the outer side of said one of the mold box mounting brackets for couplingly engaging said spacer lip.

5. The mold box assembly of claim 1, wherein said assembly further comprises a second spacer for adjustably accommodating different sized mold boxes disposed intermediate the other of the frame end brackets and the other of the mold box mounting brackets, and includes a coupler for engaging said second spacer with said other mounting bracket, and said second spacer is moveable between the two.

6. The assembly of claim 5 which further includes a retractor coupled to the second spacer to move said second spacer to accommodate placement of said mold box in said frame.

7. The mold box assembly of claim 1, wherein said retractor includes a bore disposed centrally in said one frame end bracket, a threaded bore disposed centrally in a side of said spacer, with said bore and said threaded bore being coaxial with respect to each other, and an associated bolt threaded adjacent a bolt end so as to engage said spacer when said bolt is fully extended through said bores.

8. The mold box assembly of claim 7, wherein said one mounting bracket further includes a pair of threaded bores spaced apart from each other and a pair of bores having ends disposed in said spacer, with said threaded bores and said bores in said spacer being coaxial with respect to each other, and a pair of associated bolts threaded adjacent their heads so as to engage said threaded bores in said end bracket when said bolts are fully extended through said end bracket with the ends of said bolts abutting the ends of said spacer bores.

9. In a machine for forming molded concrete products having a substantially rectangular mold box disposed in a substantially rectangular support frame wherein the sides of the mold box are substantially shorter than the sides of the frame, an adaptor for fixedly supporting such a smaller-sized mold box in the frame, the adaptor comprising:

an elongate slot formed on the inner side of one of the sides of the frame;

a mounting bracket fixedly mounted adjacent at least one outer end of the mold box;

a substantially rectangular member having an expanse extending from one of its ends, with said expanse being received in said slot and slidably traveling therealong;

a retractor coupled to the member for slidably retracting said member in order to exchange mold boxes without removing the sides or ends of the frame; and means for couplingly engaging said mounting bracket and said member during a product molding operation.

10. The adaptor of claim 9, wherein said adaptor further comprises a second elongate slot disposed substantially parallel to the first slot and formed on the inner side of an opposing side of the frame, and wherein said member further includes a second expanse extending from the other of the member ends, with said second expanse being received in said second slot and slidably traveling therealong.

11. An apparatus for mounting a mold box on a machine for forming molded concrete products comprising:

a mold defining a cavity for receiving concrete, said mold having a pair of opposed side plates and a pair of opposed mounting brackets:

a mold support frame having a pair of opposed side beams and a pair of opposed end brackets:

a connecting device for mounting said support frame on said machine:

a pair of opposed substantially parallel slots formed on said support frame side beams;

a sliding plate receivable in said slots and slidable therealong:

a slot formed on one of said mold mounting brackets, said sliding plate being receivable in said one mounting bracket slot; and a retractor coupled to the sliding plate for retracting said sliding plate to accommodate placement of said mold box in said frame.

12. The apparatus of claim 11, wherein said retractor comprises a bore disposed centrally in one of the frame end plates, a threaded bore disposed centrally in a side of said sliding plate, with said bore and said threaded bore being coaxial with respect to each other, and an associated bolt threaded adjacent a bolt end so as to engage said sliding plate when said bolt is fully extended through said bores.

13. In a machine for forming molded concrete products, a mold box assembly for adjustably mounting a mold box for receiving concrete, the assembly comprising:

a substantially rectangular mold box having a pair of opposed, substantially parallel side plates and a pair of opposed substantially parallel mounting brackets positioned at opposite ends of said side plates, a support frame, for receiving said mold box, having a pair of opposed, substantially parallel side beams and a pair of opposed, substantially parallel end brackets positioned at opposite ends of the side beams, which together with the side beams form a substantially rectangular frame; and a spacer for adjustably accommodating different-sized mold boxes, disposed intermediate one of the frame end brackets and one of the mold box mounting brackets and moveable therebetween the two, wherein at least one of said pairs of mold box mounting brackets includes an outer planar surface and said spacer includes an elongate lip disposed adjacent one of the spacer sides, and wherein said coupler comprises an elongate slot on the outer side of said one of the mold box mounting brackets for couplingly engaging said spacer lip.

14. An assembly according to claim 13 wherein said pair of frame side beams are longer than said pair of mold box side plates.

15. An assembly according to claim 13 which further comprises a coupler for engaging said spacer with said one of the box mounting brackets.

16. The mold box assembly of claim 13 which further comprises a retractor coupled to the spacer to move said spacer to accommodate placement of said mold box in said frame, wherein said retractor includes a bore disposed centrally in said one frame end bracket, a threaded bore disposed centrally in a side of said spacer, with said bore and said threaded bore being coaxial with respect to each other, and an associated bolt threaded adjacent a bolt end so as to engage said spacer when said bolt is fully extended through said bores.

17. The mold box assembly of claim 16, wherein said one mounting bracket further includes a pair of threaded bores spaced apart from each other and a pair of bores having ends disposed in said spacer, with said threaded bores and said bores in said spacer being coaxial with respect to each other, and a pair of associated bolts threaded adjacent their heads so as to engage said threaded bores in said end bracket when said bolts are fully extended through said end bracket with the ends of said bolts abutting the ends of said spacer bores.

* * * * *